US005960861A

United States Patent [19]

Price et al.

[11] Patent Number: 5,960,861

[45] Date of Patent: Oct. 5, 1999

[54] COLD PLATE DESIGN FOR THERMAL MANAGEMENT OF PHASE ARRAY-RADAR SYSTEMS

[75] Inventors: Donald C. Price, Richardson; Richard M. Weber, Prosper; Gary J. Schwartz, Dallas; Joseph McDaniel, Dallas; Jose' L. Lage, Dallas, all of Tex.

[73] Assignees: Raytheon Company, Lexington, Mass.; Southern Methodist Univ., Dallas, Tex.

[21] Appl. No.: 08/417,303

[22] Filed: Apr. 5, 1995

[51] Int. Cl.[6] ..... F28F 7/02

[52] U.S. Cl. ..... 165/80.3; 165/80.4; 165/80.5; 165/165; 165/170; 165/907

[58] Field of Search ..... 165/165, 170, 165/907, 80.4, 80.5, 80.3

[56] References Cited

U.S. PATENT DOCUMENTS

| | | | |
|---|---|---|---|
| 3,396,782 | 8/1968 | Valyi | 165/170 |
| 4,230,175 | 10/1980 | Disselbeck et al. | 165/170 |
| 4,860,165 | 8/1989 | Cassinelli | 165/80.4 |
| 4,898,234 | 2/1990 | McGovern et al. | 165/907 |
| 5,145,001 | 9/1992 | Valenzuela | 165/907 |
| 5,170,319 | 12/1992 | Chao-Fan Chu et al. | 165/170 |
| 5,267,611 | 12/1993 | Rosenfeld | 165/170 |
| 5,404,272 | 4/1995 | Lebailly et al. | 165/907 |

FOREIGN PATENT DOCUMENTS

| | | | |
|---|---|---|---|
| 1247991 | 10/1989 | Japan | 165/907 |

*Primary Examiner*—Edward K. Look
*Attorney, Agent, or Firm*—Baker & Botts, L.L.P.

[57] ABSTRACT

A cold plate for use in a thermal management system and a method of thermal management which comprises an inlet channel having coolant fluid disposed therein at a substantially uniform pressure throughout the inlet channel and an outlet channel having coolant fluid disposed therein at a substantially uniform pressure lower than the pressure in the inlet channel throughout the outlet channel. The cold plate includes a highly thermally-conductive metallic porous matrix filling the fluid passage, preferably of aluminum. The porous matrix is preferably from about two percent to about 15 percent percent solid.

19 Claims, 1 Drawing Sheet

Fig.5

COLD PLATE DESIGN FOR THERMAL MANAGEMENT OF PHASE ARRAY-RADAR SYSTEMS

BACKGROUND OF THE INVENTION

1. Field of the Invention

This invention relates to liquid-cooled cold plates and to the use of porous media, preferably in the form of an aluminum porous matrix, to improve the design of liquid-cooled cold plates, primarily for use in removing waste heat from microwave modules in phased-array-radars.

2. Brief Description of the Prior Art

Currently there are two basic flow options for liquid-cooled cold plates used in thermal management systems for phased-array-radars. A series-flow arrangement cools each cold plate, with modules containing the electronics secured thereto, in series (i.e., one after the other). This results in a large temperature difference between like-components in successive modules since the temperature of the cooling fluid increases along its travel path due to the extraction of heat from the modules via the cold plate. The large temperature difference adversely affects the electrical performance of the array since like components at different locations in the cooling fluid travel path will be at different temperatures and therefore display different electrical characteristics. The solution to this problem in the prior art requires sophisticated, computerized calibration techniques to compensate for these differences.

A parallel-flow arrangement, if attainable, would cool each module in parallel with all other modules in the array, resulting in a uniform temperature between modules and optimum array electrical performance. For most phased-array-radar arrays, however, the scale of the array is small and prior art attempts to utilize parallel-flow cold plates have been unsuccessful because the changes in flow direction required by the small scale and the lack of adequate plenum space result in poorly distributed coolant flow. This poorly distributed flow results in excessive temperature differences between modules, the very problem that the parallel flow concept was intended to solve.

Typically, cold plates used to provide thermal management for phased-array radar modules are constructed by placing a small thickness (typically 0.040 inches) of lanced-offset finstock between two thin (approximately 0.40 inches) aluminum cover plates and vacuum-brazing them together to form a unified assembly. The finstock has approximately 15 to 20 fins per inch which creates a large number of smaller flow passageways. This increases the convective heat transfer coefficient between the cover plates and the liquid coolant flowing between the plates. The finstock also increases the available surface area for heat transfer. The combination of the increase in the heat transfer coefficient and the increase in the surface area available for heat transfer creates an enhancement to the heat transfer, which results in a decrease in the temperature of the aluminum cover plates.

The microwave modules generally contain a thin-film electrical network and electronic components which dissipate heat as they generate and process microwave signals. Component, module, and array reliability are a direct function of component junction temperatures within the modules. The heat generated within the thin-film circuits is conducted to the base of the module which is mounted (screwed, soldered, or epoxied) to the top and bottom surfaces of the cold plate. When the liquid coolant is circulated through the coldplate internal passageways, module and component waste heat is transferred to the flowing coolant and transported away from the array. The more efficient the transfer of heat to the coolant stream, the more reliable the array performance. Efficiency is measured in terms of the temperature difference between the fluid temperature and resulting component temperatures. The smaller the temperature difference, the higher the efficiency. Equally important is the temperature gradient between the modules. For calibrated and stable array operation, the module-to-module difference in temperature should be minimized. In the ideal case, similar components in all modules will have the same operating temperature. The desire is to approach idealized conditions as closely as possible.

SUMMARY OF THE INVENTION

In accordance with the present invention, a porous metallic matrix is used to provide superior phased-array cold plate thermal performance, and permit operation of the cold plate in a parallel flow arrangement with a uniformity of coolant travel through the cold plate not obtainable in the prior art. The preferred porous matrix is aluminum, though other metal porous media with appropriate properties can be used. A copper matrix would be an example of such other porous media. The efficiency of heat transfer is greatly enhanced with the aluminum porous matrix as compared with finstock of the prior art. For higher-power transmit modules, the temperature rise between the fluid to cold plate mounting surface is reduced by more than 90 percent by use of the present invention. This reduction lowers the device junction temperature an equal amount and results in a very significant increase in array reliability. When the porous medium is also used as a means to provide a uniform flow within the cold plate and under the modules, the temperature gradients noted in the prior art designs are essentially eliminated.

Briefly, there is provided a cold plate in a parallel flow arrangement. The cold plate has its fluid passage disposed between the same inlet open channel fluid header communicating with one end of the fluid passage of the cold plate, wherein the fluid pressure is substantially uniform and at a uniform temperature along the entire length thereof, and the same outlet open channel fluid header communicating with the other end of the fluid passage of the cold plate, wherein the fluid pressure is substantially uniform along the entire length thereof, but at a lower pressure than in the inlet open channel fluid header. As a result of using the metallic porous medium in the fluid passage rather than the fins of the prior art and since the pressure drop across the cold plate is uniform and the structure of the fluid passage under each module is substantially identical, the fluid flow passing through the cold plate under each module will be substantially equal and travel therethrough at substantially the same rate, thereby maintaining the temperature of components at the same level (distance between the inlet open channel fluid header and the outlet open channel fluid header) in each of the various modules coupled to the cold plate at substantially the same temperature. In this way, by having identical circuitry from module to module at the same level, the electrical characteristics of these circuits will be the same.

The rate of fluid flow through the cold plate under each module is determined by the composition of the cold plate fluid passage. The cold plate is composed of a passageway with a rectangular cross-section that has two pairs of opposing walls. A fluid inlet region is disposed within the passageway along one wall of one of the pairs of opposing walls and extends along the entire portion abutting that wall. A fluid outlet region is disposed within the tube along the other of the pair of opposing walls and extends along the entire portion of that wall. The inlet and outlet regions communicate through a fluid passage composed of a region of porous medium, preferably aluminum metal matrix, having interconnecting pores. The percentage of metal to void in the porous volume used in a given application is determined by the fluid mass flow rate desired through the porous material for a given pressure differential between inlet and outlet regions as well as the viscosity of the fluid being utilized. Generally, the percentage of metal to void in the volume will vary from about two percent to about 15 percent. An aluminum porous material of this type is manufactured by ERG under the trademark Duocel.

In operation, fluid coolant, which can be a gas or a liquid, enters the fluid inlet region via an inlet in one of the side walls of the cold plate and travels along the entire fluid inlet region due to the resistance to fluid flow provided by the metallic porous medium in the fluid passage. The fluid passes through the porous material within the passage of the cold plate and absorbs heat and then passes to the fluid outlet region. Since the pressure drop across the fluid passage under each module is uniform from module to module and since each fluid passage offers substantially the same impedance to fluid flow, the fluid flows through each fluid passage at the same rate and absorbs the same amount of heat from each module. The heated fluid then exits the cold plate from the fluid outlet region and an outlet in a side wall of the cold plate where it can be cooled and recirculated or expelled. It should be understood that the direction of coolant fluid flow through the cold plate can be in either direction.

DESCRIPTION OF THE PREFERRED EMBODIMENT

Figure 1:
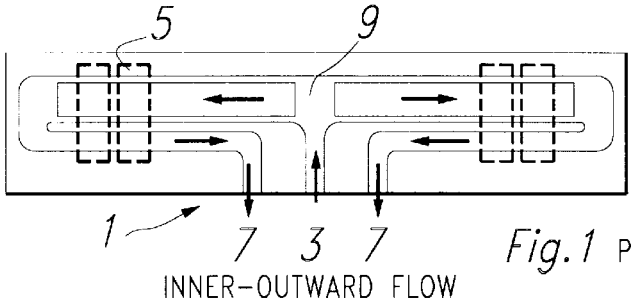
Fig.1 PRIOR ART
FIG. 1 is a schematic diagram of a prior art cold plate with a series flow arrangement.
Figure 2:
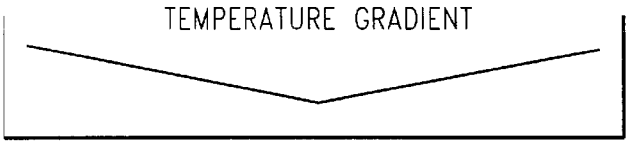
Fig.2 PRIOR ART
FIG. 2 is a diagram of the temperature gradient along the fluid travel path of the system of FIG. 1.

Referring first to FIG. 1, there is shown a schematic drawing of a prior art cold plate 1 with a series flow arrangement. Cooling fluid enters an inlet 3 and travels along the path 9 in the directions of the arrows, under the modules 5 which contain the electronics and then to outlets 7 where the fluid coolant is expelled from the system. As can be seen with reference to FIG. 2, the temperature of the fluid coolant at the inlet 3 is lowest and the temperature of the fluid coolant gradually rises along the fluid coolant flow travel path. This means that modules 5 at the beginning of the path are cooled to a greater extent than are modules farther down the path with the amount of cooling progressively diminishing with greater distance along the path. In a second type of thermal management system with a series flow, the structure is as shown in FIG. 1 with the inlets being where the outlets are shown and the outlet being where the inlet is shown. The system operates in the same manner as discussed above except that the temperature gradient curve of FIG. 2 is inverted. The problems inherent in this type of prior art system are discussed hereinabove.

Figure 3:
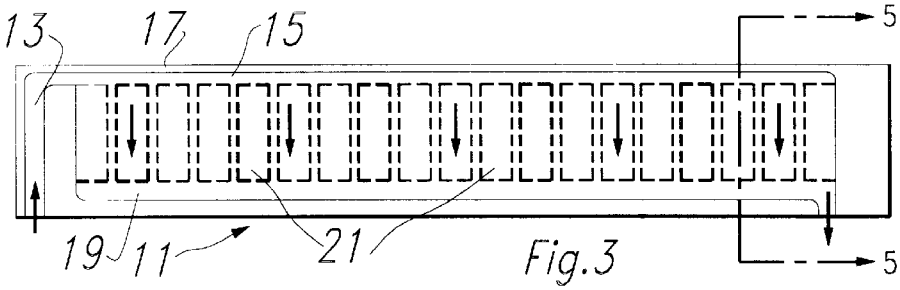
FIG. 3 is a schematic diagram of a cold plate with a parallel flow arrangement which uses a cold plate arrangement in accordance with the present invention.
Figure 4:
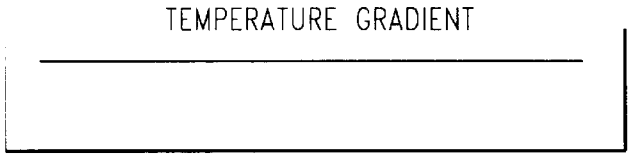
FIG. 4 is a diagram of the temperature gradient along the fluid travel path of the system of FIG. 3 when using the cold plate arrangement of the present invention.

Referring now to FIGS. 3 and 4, there is shown a schematic diagram of a cold plate system 11 with a parallel flow arrangement which uses a coolant flow arrangement in accordance with the present invention. The system 11 includes a fluid coolant inlet 13 which communicates with a fluid coolant inlet region 15 along side wall 17 of the system 11. The fluid coolant inlet region 15 communicates with the fluid coolant outlet region 19 via the enclosed passageway filled with porous medium 31 with modules 21 attached thereto (FIG. 3), the fluid passage 23 (FIGS. 5 and 6) of cold plate 11 being in direct communication with each of the fluid inlet region 15 at its inlet 27 and with the fluid outlet region 19 at its outlet 29. It can therefore be seen that the cold plates with modules 21 attached thereto have equal coolant flow, each provided between the fluid inlet region 15 and the fluid outlet region 19.

Figure 5:
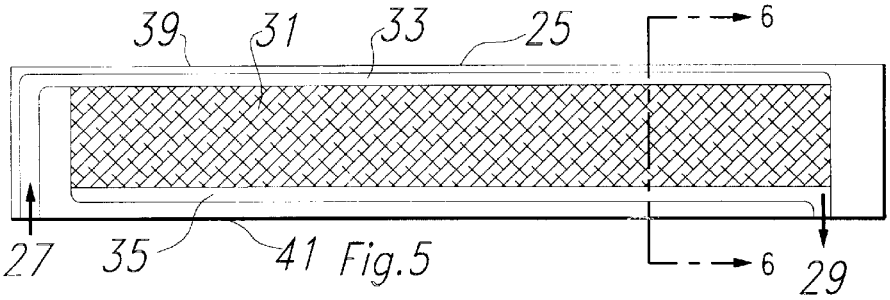
FIG. 5 is a cross sectional view of the cold plate in FIG. 3 with the top cover removed to expose the inlet passages, metal porous medium and outlet passages.
Figure 6:
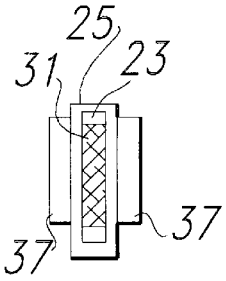
FIG. 6 is a cross sectional view along the line 5—5 of FIG. 3.

The fluid from inlet passage 27 passes through a porous matrix region 31 and then passes to the fluid outlet 29 of FIG. 5. The cold plate 11 has its fluid passage disposed between an inlet open channel fluid header 33 communicating with one end 35 of the fluid passage of the cold plate, wherein the fluid pressure is substantially uniform and at a uniform temperature along the entire length thereof, and an outlet open channel fluid header 35 communicating with the other end of the fluid passage of the cold plate, wherein the fluid pressure is substantially uniform along the entire length thereof, but at a lower pressure than in the inlet open channel fluid header 15. Since the pressure across the cold plate 11 is the same and the structure of each fluid passage 23 is substantially the same, the fluid flow passing under each module will be substantially equal and travel therethrough at substantially the same rate, thereby maintaining the temperature of components in the modules 37 coupled to the cold plate 11 (FIG. 5) at the same level at substantially the same temperature.

The cold plate 11 is composed of a passageway having a hollow central portion 23 with a rectangular cross-section which is the fluid passage and has two pairs of opposing walls. The fluid inlet portion 33 of the fluid passage region 23 is disposed within the passageway along wall 39 and extends along the entire portion abutting that wall. A fluid outlet region 35 is disposed within the passageway along the opposing wall 41 and extends along the entire portion of that wall. The inlet 33 and outlet 35 regions communicate through a fluid passage portion composed of a region of foam 31, preferably aluminum foam, having interconnecting porosity. The required percentage of metal to void in the volume is determined by the fluid mass flow rate desired through the foam for a given pressure differential between inlet and outlet regions as well as the viscosity of the fluid being utilized. Generally, the percentage of metal to void in the volume varies from about two percent to about 15 percent. An aluminum material of this type is manufactured by ERG under the trademark Duocel.

In operation, fluid coolant, which can be a gas or a liquid, enters the fluid inlet region via an inlet in one of the side walls of the cold plate and travels along the entire fluid inlet region due to the resistance to fluid flow provided by the porous medium in the fluid passage. The fluid passes through the fluid passage filled with porous medium and absorbs heat from the module and then passes to the fluid outlet region. Since the pressure across the porous matrix 31 is uniform, the fluid flows uniformly through the metallic porous medium, filling the passageway at the same rate and absorbs the same amount of heat from the heat producing module. Furthermore, since the heat from the modules is conducted to the porous matrix and the porous matrix fills the entire fluid passage, the transfer of heat to the fluid is much more efficient as compared with the prior art since the surface area available to the cooling fluid is much greater than in the prior art. The heated fluid then exits the cold plate from the fluid outlet region and an outlet in a side wall of the cold plate where it can be cooled and recirculated or expelled.

As can be seen with reference to FIG. 4, the temperature gradient of the cold plate 11 is uniform since the temperature and pressure of the cooling fluid is uniform in the inlet region 33 and in the outlet region 35. Accordingly, the components in the modules 37 which are at the same level (i.e., distance from the entrance of the fluid passage 23) will be at the same temperature.

Though the invention has been described with respect to a specific preferred embodiment thereof, many variations and modifications will immediately become apparent to those skilled in the art. It is therefore the intention that the appended claims be interpreted as broadly as possible in view of the prior art to include all such variations and modifications.

We claim:

1. A cold plate for use in a thermal management system which comprises:

(a) a plurality of fluid passages having a common cooling fluid inlet region and a common cooling fluid outlet region; and (b) a metallic porous matrix filling each of said fluid passages between said fluid inlet region and said fluid outlet region to maintain a uniform pressure differential across each of said passages.

2. The cold plate of claim 1 wherein said metallic porous matrix is made of aluminum.

3. The cold plate of claim 2 wherein said porous matrix is from about two percent to about 15 percent solid.

4. The cold plate of claim 1 further including a module secured to said cold plate thermally coupled to said porous material.

5. The cold plate of claim 2 further including a module secured to said cold plate thermally coupled to said porous material.

6. The cold plate of claim 3 further including a module secured to said cold plate thermally coupled to said porous material.

7. A cold plate system which comprises:

(a) an inlet channel having fluid coolant disposed therein at a substantially uniform pressure throughout said inlet channel;

(b) an outlet channel having fluid coolant disposed therein at a substantially uniform pressure lower than said pressure in said inlet channel throughout said outlet channel; and (c) a cold plate having a cooling fluid inlet region coupled to said inlet channel, a cooling fluid outlet region coupled to said outlet channel, a plurality of fluid passages coupled between said inlet region and said outlet region and a metallic porous matrix filling said fluid passages of said cold plate providing a uniform pressure differential across each of said fluid passages.

8. The cold plate system of claim 7 wherein said metallic porous matrix is highly thermally conductive.

9. The cold plate system of claim 8 wherein said porous matrix is aluminum.

10. The cold plate system of claim 8 wherein said porous matrix is from about two percent to about 15 percent solid.

11. The cold plate system of claim 9 wherein said porous matrix is from about two percent to about 15 percent solid.

12. The cold plate system of claim 7 further including separate modules secured to said cold plate thermally coupled to said porous matrix.

13. The cold plate system of claim 8 further including separate modules secured to said cold plate thermally coupled to said porous matrix.

14. The cold plate system of claim 9 further including separate modules secured to said cold plate thermally coupled to said porous matrix.

15. The cold plate system of claim 10 further including separate modules secured to said cold plate thermally coupled to said porous matrix.

16. The cold plate system of claim 11 further including separate modules secured to said cold plate thermally coupled to said porous matrix.

17. A method of thermal management which comprises:

(a) providing an inlet channel having coolant fluid disposed therein at a substantially uniform pressure throughout said inlet channel;

(b) providing an outlet channel having coolant fluid disposed therein at a substantially uniform pressure lower than said pressure in said inlet channel throughout said outlet channel;

(c) providing a cold plate, said cold plate having a cooling fluid inlet region coupled to said inlet channel, a cooling fluid outlet region coupled to said outlet channel, a plurality of fluid passages coupled between said inlet region and said outlet region and a metallic porous matrix filling each of said fluid passages of said cold plate to provide a uniform pressure differential across each of said passages; and (d) causing said coolant to flow through each of said passages.

18. The method of claim 17 wherein said porous matrix is highly thermally conductive.

19. The method of claim 18 wherein said porous matrix is aluminum.

* * * * *